United States Patent [19]

Dorman

[11] 4,099,362

[45] Jul. 11, 1978

[54] STRUCTURING MECHANISM IN READER-FILLER MACHINE FOR MICROFICHE JACKETS

[75] Inventor: Isidore Dorman, Whitestone, N.Y.

[73] Assignee: NB Jackets Company, Chicago, Ill.

[21] Appl. No.: 830,811

[22] Filed: Sep. 6, 1977

[51] Int. Cl.[2] ..... B65B 5/10

[52] U.S. Cl. ..... 53/123

[58] Field of Search ..... 53/123

[56] References Cited

U.S. PATENT DOCUMENTS

| | | | |
|---|---|---|---|
| 2,892,295 | 6/1959 | McArthur | 53/123 |
| 3,141,276 | 7/1964 | Anderson et al. | 53/123 |

*Primary Examiner*—Travis S. McGehee
*Attorney, Agent, or Firm*—Michael Ebert

[57] ABSTRACT

A structuring mechanism for a reader-filler machine adapted to cut and insert sections of microfilm into the channels of a multi-channel microfiche jacket, each channel having an entry slot adjacent the rear end of the jacket. The jacket to be loaded and structured is placed on the inclined platform of a carriage that is shiftable stepwise in a path at right angles with respect to a stationary film trackway. A retractable film pusher operates at a pusher station parallel to the trackway. After a section of film is inserted in a channel and is cut from the film on the trackway to produce a film chip whose tail extends outside of the channel entry slot, the platform is then indexed to bring the next empty channel into line with the trackway, the tail of the chip being brought by this step into alignment with the film pusher which acts to engage the tail and push it into the channel to complete the insertion. The structuring mechanism is used for chips whose length is shorter than the channel length, this mechanism serving to advance the chip in the channel to a point where its leading edge coincides with the front end of the jacket. This mechanism includes a retractable structuring pusher which operates at the pusher station above or below the film pusher. The structuring pusher is adapted to engage the trailing edge of the film chip in the channel and to push the chip to the desired position.

9 Claims, 9 Drawing Figures

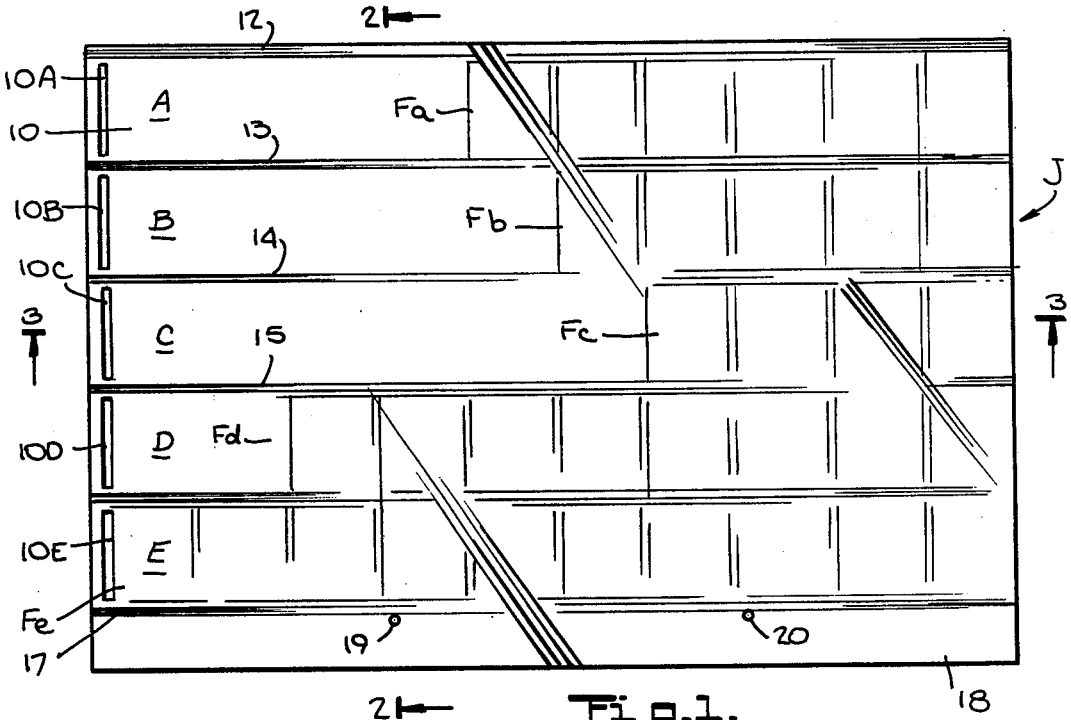
Fig. 1.
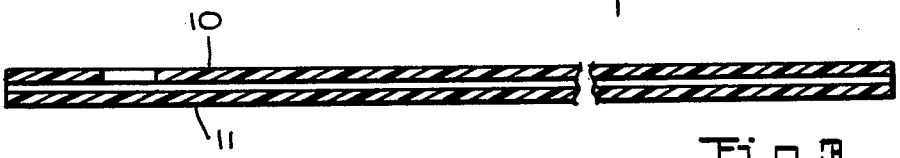
Fig. 3.
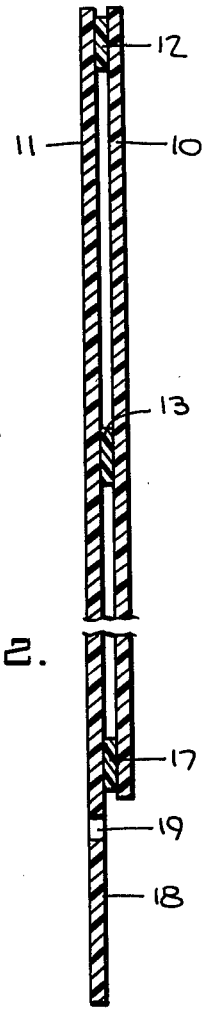
Fig. 2.
Fig. 8.
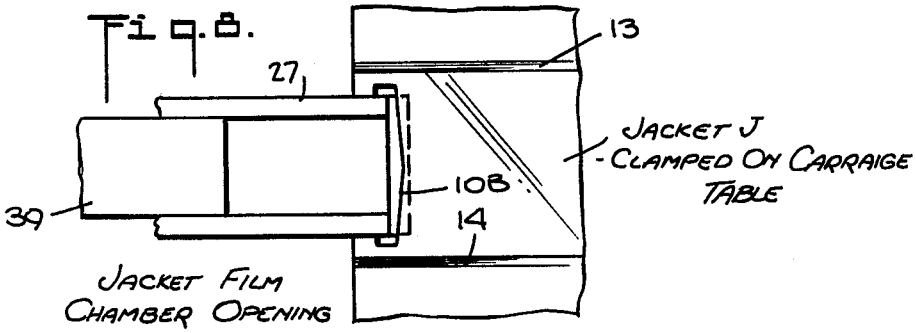
Fig. 9.
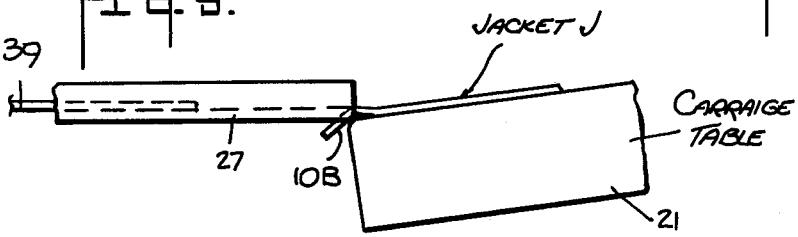

STRUCTURING MECHANISM IN READER-FILLER MACHINE FOR MICROFICHE JACKETS

BACKGROUND OF INVENTION

This invention relates generally to a reader-filler machine for loading a multi-channel microfiche jacket with microfilm chips, and more particularly to a machine of this type which includes a structuring mechanism adapted to bring into registration the leading edges of all chips within the several channels of the jacket regardless of the length of the chips.

U.S. Pat. No. 3,238,655, entitled "Microfiche Master," discloses a microfiche master composed of a transparent jacket formed by two plastic panels laminated together by ribs which are spaced to define a series of chambers or channels adapted to accommodate microfilm frames. The loaded, multi-channel jacket functions as a microfiche master from which reference copies may be made. This is effected by contact-printing through the front panel which is quite thin, the back panel being thicker to impart body to the jacket. Such microfiche masters are highly useful in storing and disseminating information.

In U.S. Pat. Nos. 2,937,483 and 3,238,655, a film-feeding machine is disclosed which functions to slice microfilm and to insert the cut pieces or chips into the channels of the microfiche jacket. By the use of this machine, insertions are made by placing the microfiche jacket on an inclined platform carriage which is shiftable to register successive jacket chambers with the leading edge of the incoming film, the film being guided along a trackway terminating adjacent the edge of the platform. In operation, a film chip constituted by one or more microfilm frames is advanced into a selected chamber and the trailing edge of the section is severed. The platform is then indexed to the next chamber position for a new insertion.

To facilitate insertion of film chips, the microfiche jacket is provided with entry slots adjacent the front ends of the chambers, thereby making it possible to insert the film laterally at an angle to the plane of the jacket rather than in an endwise direction which entails exact co-planar alignment of the film with the jacket. Since a flexible film has a tendency to curl, the advantage of angular insertion is that the angle of insertion is not critical; for the film entering the slot then bends inwardly into the chamber and is admitted without difficulty. This is the reason why the platform on which the jacket is supported is inclined relative to the film trackway.

The film is sliced at a point directly adjacent the edge of the jacket. Since the slot through which the film enters the chamber is displaced from this edge, the cut section is not fully inserted and a short tail thereof remains exposed. If a subsequent insertion is to be made in the same chamber, the tail is objectionable, for it prevents a new insertion. Thus it becomes necessary to employ a pusher element to clear the slot and thereby complete the insertion.

In loading a multi-channel microfiche jacket with microfilm chips cut from a film reel, some of the chips will be longer than others. The largest acceptable chip is one that fully occupies the chamber or channel, but depending on the information to be stored, some chips may be shorter. If, for example, the largest acceptable chip has ten image frames, some may have eight or nine, and others only two or three.

It is sometimes essential or desirable that all chips loaded into the several channels have their right or leading edge in line with the right end of the jacket regardless of the length of the chips, so that all leading edges of the chips are in registration with each other. The reason for so "structuring" a microfiche jacket is to facilitate referencing in the X and Y coordinates, whereby all leading edges of the chips terminate in a common Y axis.

Such structuring can be accomplished when using a reader-filler machine of the type covered by the Dorman U.S. Pat. No. 3,872,645, whose entire disclosure is incorporated herein by reference. In the machine disclosed in the Dorman patent, the jacket to be loaded is supported on a platform that is shiftable stepwise in a path at right angles with respect to a film trackway, each channel having an entry slot adjacent the leading edge of the jacket. In parallel with the trackway is a retractable film pusher whereby when the trackway is aligned with a selected channel, the pusher is then in registration with the next adjacent channel. Interposed between the platform and the trackway is a film slicer.

After an operator draws from a film reel a predetermined section of film which he advances along the trackway into the channel aligned therewith through its entry slot, a switch is actuated to initiate an automatic three-phase cycle. In the course of this cycle, first the slicer operates to cut the film whereby the tail of the severed section or chip extends outside the slot; then the platform is indexed to shift the loaded chamber into alignment with the pusher while placing the next empty chamber in line with the trackway in readiness for the next insertion; and finally the film pusher acts to engage the tail, pushing it into the slot to thereby complete the insertion of the chip into the chamber.

If the inserted chip so pushed into the chamber is shorter than the length thereof, then the trailing edge of the chip is in line with the left or trailing end of the jacket. But to effect structuring, it is necessary that the leading edge of the chip be lined up with the right or leading end of the chamber.

In order to accomplish structuring with the Dorman machine, the chamber loaded with the chip has first to be indexed in the reverse direction to bring it back into alignment with the film trackway. Then the film in the trackway is used by the operator as a pushing tool to engage the trailing edge of the chip and to push it until its leading edge is positioned adjacent the leading end of the jacket. Then the film is retracted. Thus the film to be later inserted in an empty channel is also used to effect structuring of a film chip already inserted in a loaded channel.

There are a number of practical objections to this procedure. First: the reverse indexing of the platform interferes with the normal forward indexing procedure; Second: the use of film as the pushing tool into and out of the chamber may mar the surface of the film; Third: the film, especially if it is very thin and delicate, may lack sufficient stiffness to function effectively as a structuring element and the film may collapse; and Fourth: in the case of a filler-reader machine operating with very thin film, the butting of the end of the film used as a pushing tool with the end of the film being pushed is critical, and there is a tendency for the pushing film to ride over rather than to push the film to be pushed.

SUMMARY OF INVENTION

In view of the foregoing, it is the main object of this invention to provide in a reader-filler machine adapted to insert chips of microfilm into the channels of a multi-channel jacket, a structuring mechanism for advancing the inserted chips so that the leading edges of all chips are in registration with respect to a common reference axis.

More particularly, it is an object of this invention to provide a manually-operated structuring mechanism which occupies the same station as the film pusher so that at the conclusion of an automatic three-phase cycle when the tail of the film chip has been pushed into a given channel of the jacket, the operator may then, by means of the structuring mechanism, advance the chip already in the channel to a point where its leading edge coincides with the front end of the jacket.

A significant advantage of a structuring mechanism in accordance with the invention is that it does away with the need to use microfilm as a structuring tool. Moreover, it obviates the need to index the platform containing the jacket in the reverse direction to bring it back into alignment with the film trackway in order to effect structuring.

Thus in an arrangement in accordance with the invention, structuring may be manually effected at the end of an automatic three-phase cycle without indexing the platform, so that after structuring is completed, one may then immediately initiate another three-phase cycle.

Another feature of the invention is that the same manually-operated knob which acts to operate the drive roll advancing film along the trackway serves in another operative position to operate the drive roll advancing the structuring pusher. Interlock means are provided to prevent cycling of the reader-filler machine as long as the structuring pusher is active or not fully retracted.

Briefly stated, these objects are attained in a reader-filler machine which includes a structuring mechanism, the machine being adapted to cut and insert sections of microfilm drawn from a reel into the channels of a multi-channel microfiche jacket, each channel having an entry slot adjacent the rear end of the jacket.

The jacket to be loaded and structured is placed on the inclined platform of a carriage that is shiftable stepwise in a path at right angles with respect to a stationary film trackway, the film drawn from the reel being conducted along the trackway into the channel aligned therewith. A retractable film pusher operates at a pusher station parallel to the trackway. After a section of film is inserted in a channel and is severed from the film on the trackway to produce a film chip whose tail extends outside of the channel entry slot, the platform is then indexed to bring the next empty channel into line with the trackway, the tail of the chip being brought by this step into alignment with the film pusher which acts to engage the tail and push it into the channel to complete the insertion.

The structuring mechanism is used for chips whose length is shorter than the channel length, this mechanism serving to advance the chip in the channel to a point whose leading edge coincides with the front end of the jacket. The mechanism includes a retractable structuring pusher in ribbon form. The structuring pusher, which operates at the pusher station above or below the film pusher, is adapted to engage the trailing edge of the chip in the channel and to push the chip to the desired position.

OUTLINE OF DRAWINGS

For a better understanding of the invention as well as other objects and further features thereof, reference is made to the following detailed description to be read in conjunction with the accompanying drawings, wherein:

FIG. 1 is a plan view of a microfiche master loaded with structured microfilm chips;

FIG. 2 is a transverse section taken in the plane indicated by line 2—2 in FIG. 1;

FIG. 3 is a longitudinal section taken in the plane indicated by line 3—3 in FIG. 1;

FIG. 8 is a plan view of the pusher station to illustrate the relationship between the film pusher and the structuring pusher; and FIG. 9 is a side view of the pusher station.

DESCRIPTION OF INVENTION

Microfiche Master

Figure 4:
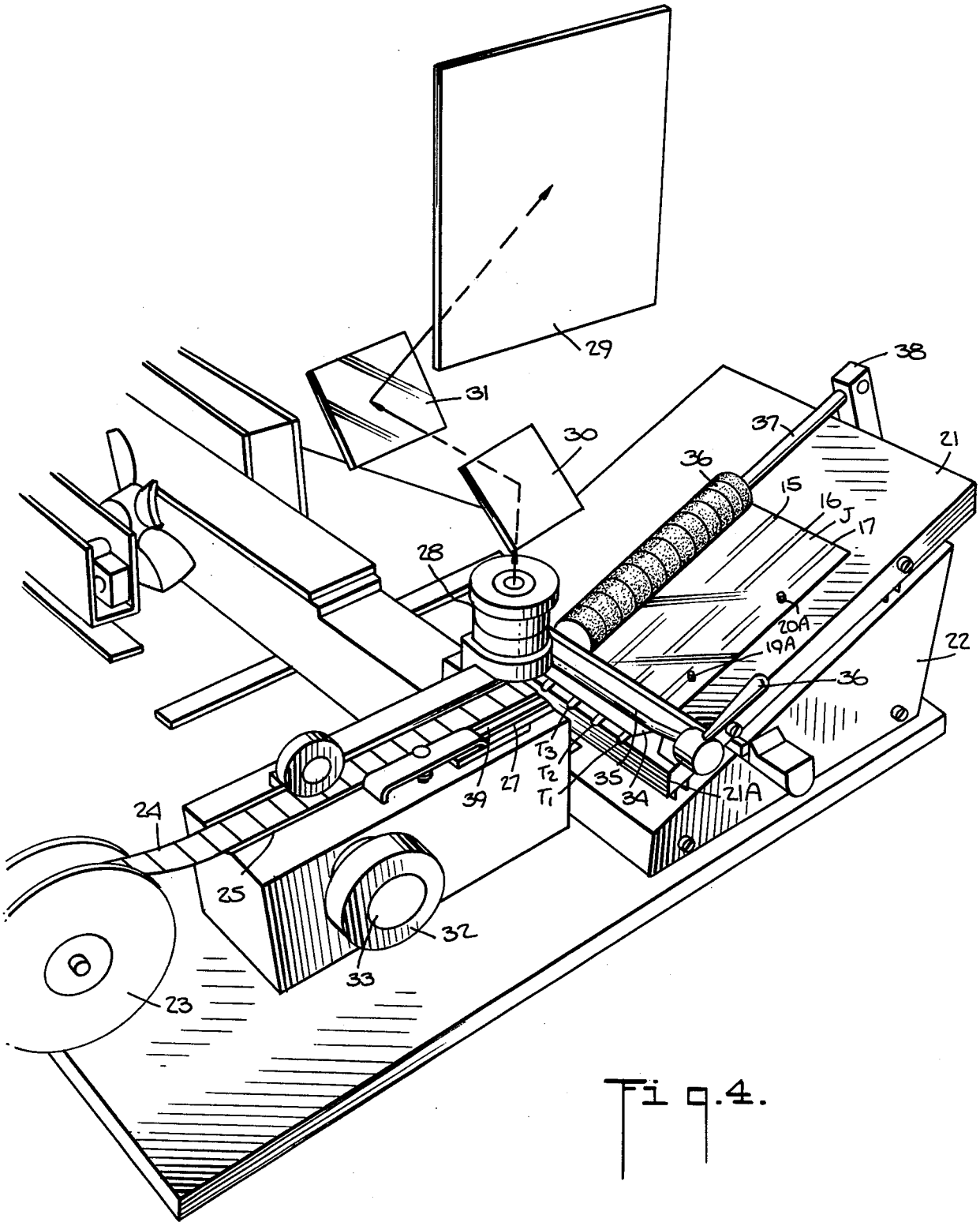
FIG. 4 is a perspective view of the reader-filler machine which incorporates a structuring mechanism in accordance with the invention.

Referring now to FIGS. 1, 2 and 3, a microfiche master is shown, the master being constituted by a transparent multiple-chamber jacket J having parallel channels or chambers A, B, C, D and E.

Jacket J is constituted by two transparent rectangular panels 10 and 11 in superposed relation, the panels being formed of clear, flexible plastic material, such as cellulose acetate, Mylar, or any other suitable sheeting having high tensile strength. Interposed between the top and back panels and adhesively secured thereto are parallel ribs of plastic or paper formed by longitudinally-extending narrow ribbons 12, 13, 14, 15, 16 and 17 to define chambers A to E which are open at either end. The chambers are of like width to accommodate microfilm of a given size, such as 16 mm film.

Back panel 10 is somewhat wider than top panel 11, to provide a marginal extension which is coated with translucent coating 18 for titling the microfiche master. This title will be reproduced in contact-printing, because of the translucency of the coating.

To facilitate insertion of microfilm, rectangular slots 10A to 10E are cut across back panel 10 adjacent the front end of the chamber openings. Top panel 11 is of thin, clear plastic material (i.e., about 1 mil or less) to facilitate contact-printing, whereas back panel 10 is preferably of heavier gauge transparent material (i.e., 3 to 5 mils) to give body to the microfiche. The ribs are of substantially the same thickness as the inserted microfilm sections, or slightly thinner, so that no space exists between the top panel and the microfilm insert and the sensitive film is virtually in contact with the microfilm when contact-printing takes place. Where the microfilm to be inserted is relatively thin (i.e., 3 mils or less), the ribs are correspondingly thin.

Also provided are two pin-locating holes 19 and 20 which are punched a longitudinally spaced positions between the titling strip 18 and the last rib 17. It is important, when inserting microfilm strips, that the jacket on the platform of the film-feeding machine be precisely in parallel relationship with the film path. A slight displacement of the jacket from its proper parallel position makes insertion difficult, for then the strip tends to travel toward one side of the channel rather than through the channel, and jamming occurs. By the use of guide pins on the platform of the film-feeding machine adapted to receive the locating holes 19 and 20, proper registration of the jacket is insured.

In loading a multi-channel microfiche master J of the type shown with microfilm sections or chips from a film reel, some chips will be longer than others. The largest acceptable chip is one that fully occupies the chamber or channel, but, depending on the information to be stored, some chips may be shorter. We shall assume, in connection with FIG. 1, that the largest acceptable film chip is one having ten frames; hence a ten-frame chip will fill the entire channel, whereas chips with a lesser number of frames will occupy only a portion of the channel.

As explained previously, in many practical applications, it is essential that all chips loaded into the several channels have their right or leading edge coincide with the right end of jacket J regardless of chip length. In this state, the chips are "structured," thereby facilitating referencing of the frames in the X and Y coordinates, for all leading edges of the chips then terminate in a common Y axis.

FIG. 1 illustrates a "structured" jacket in which film chip $F_a$ in channel A has six frames, chip $F_b$ in channel B has five frames, chip $F_c$ in channel C has four frames, chip $F_d$ in channel D has eight frames, and chip $F_e$ in channel E has ten frames. Only chip $F_e$ fully occupies its channel, all other chips falling short. However, the leading edges of all chips are in line with the right end of jacket J; hence the jacket is properly structured.

Such structuring is effected in a machine in accordance with the invention where a film pusher functions to engage the trailing edge or tail of the film chip which extends outside of the channel slot after the film is cut and to push the tail into the slot and a structuring pusher at the same station as the film pusher functions to engage the trailing edge of the chip now within the channel and to advance this chip to a point where its leading edge coincides with the leading or right end of the jacket.

Reader-Filler Machine

Figure 5:
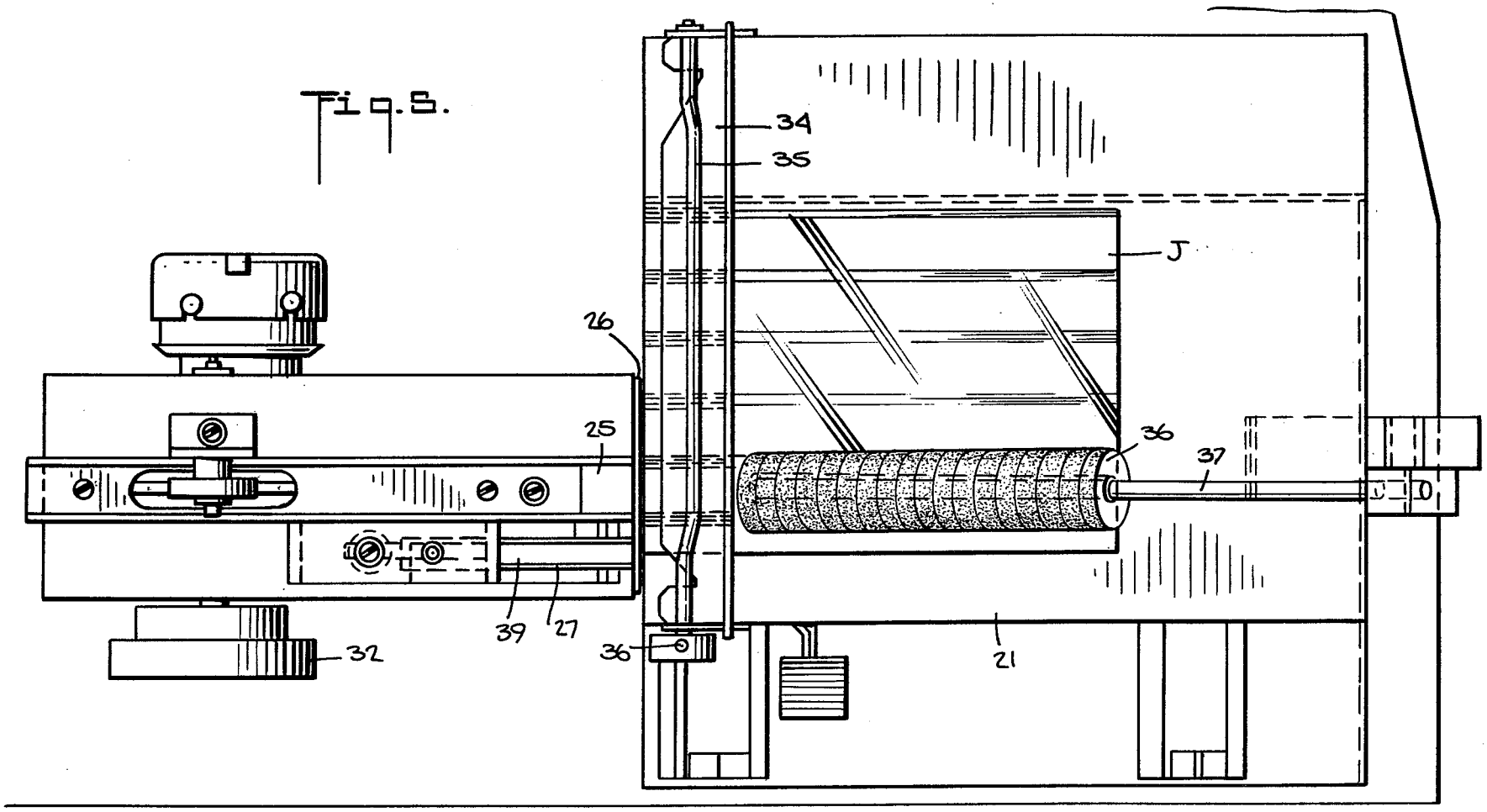
FIG. 5 is a plan view of the machine.

Referring now to FIGS. 4 and 5, there is shown an actual embodiment of a reader-filler machine in accordance with the invention. Microfiche jacket J to be filled is placed at a loading station on the inclined platform of a carriage, generally designated by numeral 21, which is movable in a stepwise manner along a stationary bed 22. A microfilm roll is carried on a spindle-borne reel 23, and drawn therefrom is a continuous film strip 24 which is fed along the trackway 25 of a film-advancing mechanism manually operated by a knob 32, the trackway terminating at a film slitter 26.

Adjacent slitter 26 in parallel relation to the trackway is a film pusher assembly, generally designated by numeral 27. The film to be inserted is viewable through an optical system 28 which projects an image on the rear view screen 29 via reflecting mirrors 30 and 31.

In operation, a jacket J to be filled is placed on the platform of carriage 21 and a channel therein is aligned with the film trackway. Guide holes 19 and 20 on the jacket are placed over guide pins 19A and 19B on the platform to ensure proper positioning of the jacket. The operator, who views the microfilm images adjacent film slicer 26, turns knob 32 of the film-advancing mechanism to insert into the operative channel as many microimage frames as desired. The operator is able to see on viewing screen 29 the position between the last inserted frame and the succeeding frame, and thereby to line up the film slicer knife midway therebetween.

The operator then presses a switch button 33, which is conveniently located within knob 32, to initiate the automatic operating cycle, wherein: first, the film is sliced, then the platform is indexed to align the channel having the incompletely inserted film with the film pusher element and to align the next channel with the trackway, and finally the film pusher is actuated to complete the insertion.

It will be seen in FIG. 4 that the leading edge 21A of the inclined platform on carriage 21 is bevelled or relieved to permit the front end of jacket J to be deflected downward from the platform. Extending across the platform adjacent the leading edge thereof is a clamp assembly constituted by an upwardly-biased clamp bar 34 operated by a lever rod 35 having a handle 36 attached to one end thereof.

Secured to the underside of clamp bar 34 is a row of equi-spaced teeth $T_1$, $T_2$, $T_3$ etc., which lie in registration with ribs 12 to 17 in the jacket placed in the platform. When the jacket clamp is operative, the teeth engage correspondingly-positioned ribs on the jacket so that the jacket position in the course of loading is firmly maintained.

When handle 36 is turned to rotate lever rod 35 to raise clamp bar 34, the clamping teeth are disengaged from the ribs on the jacket, but when handle 36 is turned to lower the clamp into engagement with the jacket ribs, then the teeth force the front end of jacket J against the bevelled leading edge 21A of the platform. When this happens, the entry slots of the jacket, such as slot 10A, are bent against the junction of the bevelled leading edge 21A of the platform and the flat surface thereof. This more effectively presents the slots to the advancing film on the trackway. By bending the entry slot, the slot is better exposed to advancing film which passes directly into the associated jacket chamber.

The nose of film pusher 27 is provided with a projecting ledge or film catcher, the film pusher being slidable within a guide bed. The film pusher is advanced or retracted by means of a drive pin whose upper end is received in a bore adjacent the rear of this element.

We shall now consider the sequence of operations which take place after a section of film has been inserted in a given chamber of jacket J lying on inclined platform 21. The front end of the jacket is deflected below the leading edge 21A of platform 21 by means of clamp 34. The film has been inserted in a given chamber through its entry slot, such as slot 10D which, because of the clamping action, is now bent to facilitate insertion and subsequent pushing. After the inserted film section is severed from the film on the trackway, a short tail extends beyond the entry slot. And since the front end of the jacket is deflected downwardly, the tail is free and clear of the front end of the jacket, thereby facilitating the subsequent pushing action.

When film pusher 27 begins to advance, the end of the film tail is received on the projecting catcher which, because of its ledge formation, prevents the tail from falling below the pusher. Since the film is very thin and relatively limp, in the absence of the catcher the tail could drop out of engagement with the pusher element, so that it would then fall over and obstruct the entry slot. In this event, it would not thereafter be possible to make a second film insertion. But with the catcher, this possibility is avoided.

As the pusher element advances, it moves from a position adjacent the front end of the jacket to the entry slot which is inwardly displaced from the front end, the film section being pushed further into the channel by means of its tail. This pusher movement continues until the tail is inserted fully within the channel to clear the entry slot. The film pusher then returns to its initial position in preparation for the next pushing action. After all film sections have been inserted and tails pushed in, jacket clamp 34 is raised to release jacket J and permit its removal from the inclined platform.

When a second section or chip of film is inserted in a jacket chamber already containing a first insert, there is a danger that with very thin film, the second section, instead of butting the end of the first section and pushing the first section further into the chamber, might run over and overlap the first section.

To avoid this possibility, the machine includes a pressure roller 36 which is in axial alignment with the particular chamber being filled. Roller 36 may be formed of a series of rings of resilient foam plastic material mounted on a shaft 37 supported on one end from a single bearing 38. Bearing 38 is mounted on a bracket attached to the fixed bed of the jacket loading station so that as the platform carriage 21 is indexed, the roller is always in line with the jacket chamber aligned with the trackway for film insertion. In practice, the roller may be formed of neoprene or any othr suitable resilient material capable of applying a light pressure on the jacket.

A more detailed disclosure of the structure and operation of this filler-reader machine is found in the above-identified Dorman patent.

The Pusher Station

Figure 6:
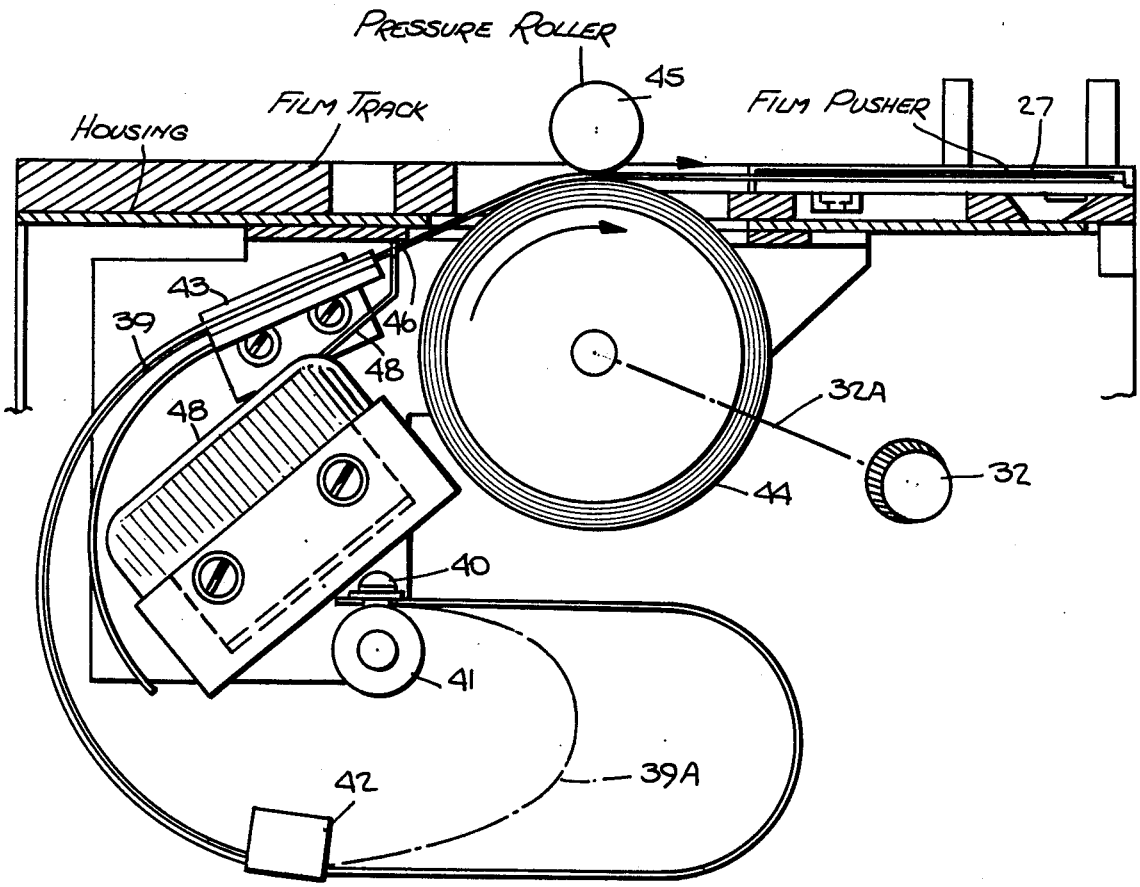
FIG. 6 is a sectional view of the structuring mechanism.
Figure 7:
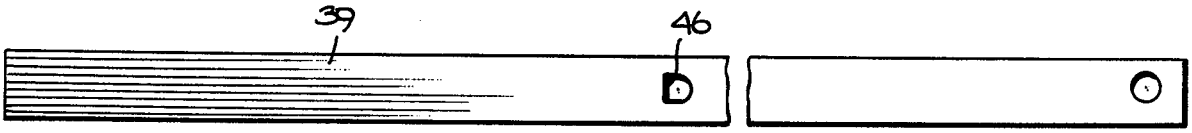
FIG. 7 is a plan view of the structuring pusher.

Referring now to FIG. 6, there is shown the pusher station of the machine where the retractable film pusher 27 is located. The upper face of film pusher 27 is provided with a longitudinal channel functioning as a guide track for the ribbon-like structuring pusher 39 which is preferably formed of a strip of spring metal or a plastic material such as polyester having spring characteristics, the thickness of the ribbon being about the same as that of the film or being somewhat thicker than the film.

The rear end of the structuring pusher ribbon is secured by a screw 40 to a post 41, the ribbon curving from the post and passing through a guide weldment 42 and a main guide 43 which conducts the ribbon between a drive roll 44 and a pressure roller 45. These rolls lead the front end of the ribbon into the guide track on film pusher 27, which track directs the ribbon into the channel in registration with the pusher station.

In the condition shown in FIG. 6, film pusher 27 is fully retracted and structuring pusher ribbon 39 is also fully retracted. When the structuring pusher ribbon is advanced by clockwise rotation of drive roll 44, the forward end of the ribbon is extended to engage the trailing edge of the film in the channel, the ribbon when fully extended assuming the curvature indicated by dashed line 39A. Thus the ribbon is held in a loop formation whose radius changes as the ribbon is advanced or retracted.

Drive roll 44 is turned by the same knob 32 which is used for turning the drive roll for advancing film on film trackway 25. To this end, knob 32 is mounted on a shaft 32A having two clutch positions. The first is a normal clutch position in which the shaft operatively engages the drive roll for the film on the trackway, this being used for film insertion. The second is the structuring position which is effective only when knob 32 is pulled out to effect operative engagement with drive roll 44 for advancing or retracting structuring pusher ribbon 39.

Thus by pulling knob 32 out and rotating the knob clockwise, the chip engaged by the structuring ribbon is advanced deeper into the channel. Rotation of the pulled-out knob in the counterclockwise direction causes the ribbon to retract.

In order to avoid machine cycling while structuring is taking place, ribbon 39 is provided with a hole 46 whose location is such that only when the ribbon is fully retracted, will the actuator pin 47 of a microswitch 48 fall into the hole to operate the switch. In all other positions of the ribbon, pin 47 is depressed by the surface of the ribbon to de-activate the switch. Switch 48 is interposed in the power circuit for the cycling mechanism of the machine; hence cycling is permitted only when the structuring ribbon is fully retracted.

While there has been shown and described a preferred embodiment of a structuring mechanism in reader-filler machine for microfiche jackets in accordance with the invention, it will be appreciated that many changes and modifications may be made therein without, however, departing from the essential spirit thereof.

I claim:

1. In a reader-filler machine adapted to insert chips of microfilm into the respective channels of a multi-channel microfiche jacket, each channel having an entry slot adjacent the rear end of the jacket, the machine including a stationary film trackway, a drive mechanism to conduct the film to be inserted along the trackway toward the entry slot of the channel then in registration with the trackway and a pusher station provided with a film pusher parallel to the trackway whereby after a section of film loaded in this channel through the entry slot is severed from the film on the trackway to produce a film chip whose tail extends outside of the entry slot, the jacket is indexed to bring the next empty channel into registration with the trackway and the tail of the chip in the loaded channel into alignment with the pusher station to permit the film pusher to engage the tail and push it into the channel to complete the insertion, a structuring mechanism at said pusher station to be used for a chip whose length is shorter than the channel length to advance the chip in the channel to a point where its leading edge coincides with the front end of the jacket, said mechanism comprising:

A. a retractable structuring pusher in the form of a relatively stiff ribbon whose thickness is at least about the same as that of the film;

B. a track in a plane parallel to the plane of the film pusher to conduct the ribbon toward the entry slot in the channel; and C. means to drive said ribbon along the track to cause the leading edge thereof to engage the trailing edge of the film chip therein and to advance the chip to the desired point, said drive means being reversible to retract said ribbon.

2. A structuring pusher mechanism as set forth in claim 1, wherein said structuring ribbon is formed of flat spring metal.

3. A structuring mechanism as set forth in claim 1, wherein said track for the ribbon is formed by a channel formed in the top face of said film pusher.

4. A structuring mechanism as set forth in claim 1, wherein the trailing edge of said ribbon is secured to a post from which the ribbon curves to define a loop whose radius changes as said ribbon is advanced or retracted by the drive means.

5. A structuring mechanism as set forth in claim 4, further including guide means for said ribbon disposed between said post and the track therefor.

6. A structuring mechanism as set forth in claim 4, wherein said drive means is constituted by a drive roll and pressure roller, the ribbon passing therebetween whereby rotation of the drive roll causes the ribbon to advance or retract depending on the direction of rotation.

7. A structuring mechanism as set forth in claim 1, wherein said machine includes motor-operated cycling means to automatically index said jacket from one channel position to the next, to then cut said film after it has been inserted, and to thereafter actuate said film pusher, further including interlocking means to interrupt power to said cycling motor when said structuring ribbon occupies any position other than a fully retracted position.

8. A structuring mechanism as set forth in claim 7, wherein said interlock means is constituted by a switch having an actuator pin which enters a hole located in said ribbon only when the ribbon is fully retracted, the pin otherwise being depressed by said ribbon to de-activate said cycling motor.

9. A structuring mechanism as set forth in claim 8, wherein said machine includes a knob selectively coupled to the drive mechanism for the film or to the drive roll for the ribbon whereby the same knob may be used to advance and retract the film or to advance and retract the ribbon.

* * * * *